US007219981B2

(12) United States Patent
Taira

(10) Patent No.: US 7,219,981 B2
(45) Date of Patent: May 22, 2007

(54) INK-JET HEAD AND PRODUCING METHOD THEREOF

(75) Inventor: Hiroshi Taira, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 57 days.

(21) Appl. No.: 10/665,546

(22) Filed: Sep. 22, 2003

(65) Prior Publication Data

US 2004/0109046 A1 Jun. 10, 2004

(30) Foreign Application Priority Data

Sep. 25, 2002 (JP) ..... 2002-278971

(51) Int. Cl.
*B41J 2/14* (2006.01)
*B41J 2/045* (2006.01)

(52) U.S. Cl. ..... 347/50; 347/68

(58) Field of Classification Search ..... 347/20, 347/50, 54, 68–73, 42
See application file for complete search history.

(56) References Cited

U.S. PATENT DOCUMENTS 4,703,333 A * 10/1987 Hubbard ..... 347/40
4,768,266 A * 9/1988 DeYoung ..... 29/25.35
6,188,414 B1 * 2/2001 Wong et al. ..... 347/42
6,802,596 B2 * 10/2004 Higuchi et al. ..... 347/68
7,004,565 B2 * 2/2006 Suzuki et al. ..... 347/50

FOREIGN PATENT DOCUMENTS

JP A 2000-94673 4/2000
JP A 2000-108344 4/2000

* cited by examiner

*Primary Examiner*—Stephen Meier
*Assistant Examiner*—Geoffrey S. Mruk
(74) *Attorney, Agent, or Firm*—Oliff & Berridge, PLC

(57) ABSTRACT

An ink-jet head is formed by laminating a passage unit including a plurality of individual ink passages running to a nozzle through a pressure chamber and a reservoir unit including an ink reservoir in which ink is stored and from which the stored ink is fed to the passage unit. The reservoir unit has a bonded portion bonded to the passage unit and a spaced portion spaced apart from and opposite to the passage unit which are formed on a bottom thereof. The spaced portion has a protrusion formed at an end thereof opposite to the bonded portion to protrude in a direction of the passage unit. FPC is drawn out from an opening between the protrusion and the passage unit and an adhesive is applied to this opening.

12 Claims, 8 Drawing Sheets

INK-JET HEAD AND PRODUCING METHOD THEREOF

BACKGROUND OF THE INVENTION

1. Field of the Invention

The present invention relates to an ink-jet head for squirting ink at recording medium for recording a formed image and the like.

2. Description of the Related Art

In the ink-jet head, ink from an ink tank is supplied to a pressure chamber through a common ink chamber, to impart squirting energy to the ink in the pressure chamber and then the energized ink is squirted from a nozzle. The head is provided with an actuator for imparting the squirting energy to the ink in the pressure chamber. The actuator is electrically connected to a flexible printed circuit (FPC). The actuator is driven under driving signal fed from a driver IC through the FPC.

A variety of actuators are in use, including a piezoelectric actuator and a capacitance type actuator. In the piezoelectric actuator, the actuator is disposed opposite to the pressure plate to form a partition wall of the pressure chamber, so that when the actuator is mechanically deformed, the pressure chamber is changed in volume to thereby impart the squirting energy to the ink in the pressure chamber. In the capacitance type actuator, a vibrating sheet is disposed to form a partition wall of the pressure chamber and the actuator is arranged to be spaced apart from and opposite to the vibrating sheet. When the vibrating sheet is deflected by electrostatic force generated by the drive of the actuator, the pressure chamber is changed in volume to thereby impart the squirting energy to the ink in the pressure chambers, as is the case with the piezoelectric actuator mentioned above.

Although there are presented a variety of actuators, including those as mentioned above, the existing actuators all suffer from the problem that when the ink adheres to the actuator, the ink squirting capability of the actuators reduces or fails. In order to minimize this problem, various techniques have been developed. Take an actuator having such a structure that FPC is bonded to the actuator and is further drawn to an outside of the head, for example. For this type of actuator, there has been proposed a technique of mounting a sealing member at a location where the FPC is drawn out, because the ink enters into the head from that location easily. According to this technique, the sealing member prevents the entry of the ink into the head, thus preventing the adhering of the ink to the actuator.

However, according to this technique, although the adhering of the ink to the actuator can be prevented, there is a possibility that the sealing member may enter into the head to cause adherence of the sealing member to the actuator. When the sealing member adheres to the actuator, the deformation of the actuator, the piezoelectric actuator in particular, is deteriorated. Further, in other types of actuators, such as a capacitance type actuator, as well, when the sealing member adheres to the actuator, the function of the actuator may deteriorate, as is the case with the actuator of the type noted above. Therefore, the existing techniques mentioned above are unsatisfactory for solving the problem of reduction of the ink squirting capability of the actuator.

SUMMARY OF THE INVENTION

It is an object of the present invention to provide an ink-jet head that can release or minimize reduction of an ink squirting capability of the actuator by preventing adhesion of ink, a sealing member and the like to the actuator, and a producing method thereof.

In accordance with a first aspect of the present invention, there is provided an ink-jet head comprising: a passage portion in which a plurality of ink ejecting nozzles are formed, the passage portion including a plurality of individual ink passages running to the nozzles through pressure chambers, a spaced portion spaced apart from and opposite to the passage portion, a driving portion, bonded to a surface of the spaced portion facing the passage portion, for imparting squirting energy to ink in the pressure chambers, a power supply member electrically connected with the driving portion, for supplying driving signals to the driving portion, a protrusion provided in at least either of the surface of the spaced portion facing the passage portion and the surface of the passage portion facing the spaced portion, and a sealing member disposed adjacent to the protrusion, for sealing a spaced between the passage portion and the spaced portion.

In the construction mentioned above, the protrusion is presented at one side of the driving portion serving as the actuator. While a construction having no protrusion can allow an easy entry of the ink into the head from the other side, the construction of the invention having the protrusion can prevent the entry of the ink into the head by the protrusion. Thus, the construction of the invention can prevent the adhering of the ink to the actuator, thus releasing or minimizing the problem of reduction of the ink squirting capability of the actuator. Further, when the sealing member is employed as in the existing technique mentioned above, since the sealing member is prevented from adhering to the actuator by the protrusion, the problem of reduction of the ink squirting capability of the actuator can be even more released.

In accordance with a second aspect of the present invention, there is provided an ink-jet head comprising; a passage unit in which a plurality of ink ejecting nozzles are formed, the passage unit including a plurality of individual ink passages running to the nozzles through pressure chambers, a reservoir unit including an ink reservoir in which ink is stored and from which the stored ink is fed to the passage unit, an actuator unit, bonded to the passage unit, for imparting squirting energy to the ink in the pressure chambers, and a power supply member electrically connected with the actuator unit, for supplying driving signals to the actuator unit, wherein the reservoir unit has a bonded surface bonded to the passage unit and a spaced surface extended across and spaced apart from the actuator unit, wherein a protrusion is provided in an area of the spaced surface of the reservoir unit, the area is opposite to the bonded surface with respect to an area facing the actuator unit, and wherein the power supply member is in abutment with both of the protrusion and the passage unit, and a sealing member for sealing a space between the passage unit and the reservoir unit is disposed at the abutment portion.

In the construction mentioned above, the actuator unit is bonded to the passage unit, and the reservoir unit is bonded to the passage unit so that the reservoir unit is extended to bridge over the actuator unit and spaced apart therefrom. This construction including the protrusion provided in said area can also provide the same effect as in the first aspect of the invention.

In accordance with a third aspect of the present invention, there is provided a producing method of an ink-jet head comprising: the step of producing a passage unit in which a plurality of ink ejecting nozzles are formed, the passage unit including a plurality of individual ink passages running to the nozzles through pressure chambers, the step of producing a protruding member having a first protrusion and a second protrusion protruding in the same direction as the direction in which the first protrusion protrudes by a half-etching, the step of producing an actuator unit for imparting squirting energy to the ink in the pressure chambers, the step of bonding the actuator unit to the passage unit, the step of electrically connecting between a power supply member for supplying driving signals to the actuator unit and the actuator unit, the step of bonding together the passage unit and the protrusion member in such a manner that a front end of the first protrusion serves as a bonded surface bonded to the passage unit; that the protrusion member has a spaced surface spaced apart from and extended across the actuator unit and that a second protrusion is located in an area which is spaced apart from the bonded surface across an opposite area of the spaced surface to the actuator unit and is not opposite to the actuator unit, and the step of disposing a sealing member for sealing a space between the passage unit and the protrusion member at an abutment portion between the power supply member and the protrusion.

The front end of the first protrusion is equivalent to the bonded surface of the second aspect of the invention. By forming both the first protrusion and the second protrusion as the protrusion in the first and second aspects of the invention by half-etching, manufacturing costs can be reduced.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
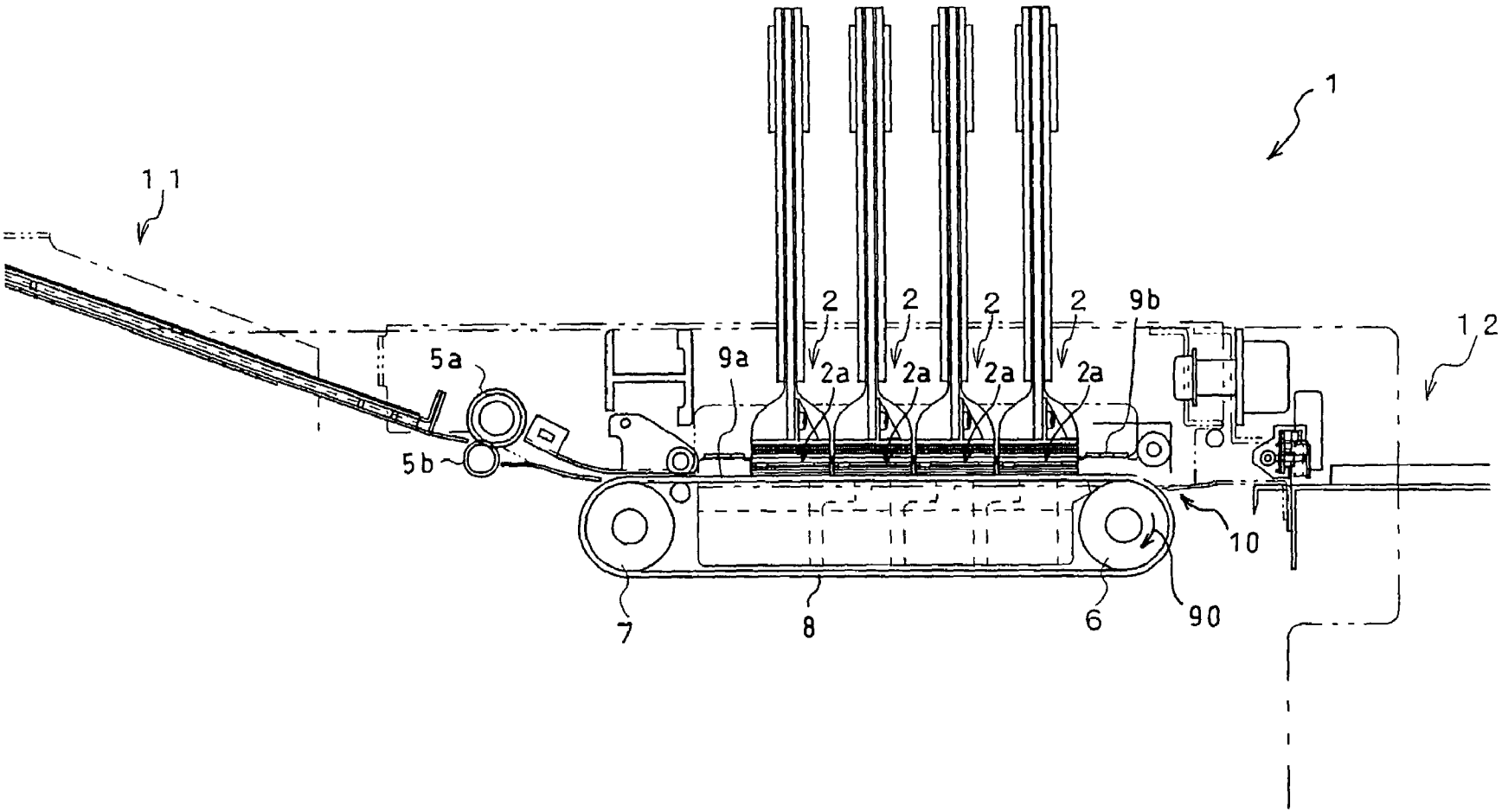
FIG. 1 is an entire construction diagram showing an example of a printer including an ink-jet head according to an embodiment of the present invention.

FIG. 1 is an entire construction diagram showing an example of a printer including an ink-jet head according to an embodiment of the present invention. The ink-jet printer 1 of this embodiment is a color ink-jet printer having four ink-jet heads 2. The ink-jet printer 1 has a paper feed portion 11 (left side when viewed in the illustration) and a paper discharge portion 12 (right side when viewed in the illustration). It also has in an interior thereof a paper carrier passage running from the paper feed portion 11 toward the paper discharge portion 12.

A pair of paper feed rollers 5*a*, 5*b* are disposed on the directly downstream side of the paper feed portion 11, to feed the paper of the recording medium from the left to right when viewed in the illustration. Two belt rollers 6, 7 and a loop carrier belt 8 extended between the both rollers 6, 7 are disposed in an intermediate portion of the paper carrier passage.

The carrier belt 8 has a two-layer structure comprising a polyurethane base material impregnated with urethane and a silicon rubber located on a carrying surface side of the carrier passage. The paper carried by the pair of paper feed rollers 5*a*, 5*b* is held on the carrying surface on the front side of the carrier belt 8 through absorption, while it is carried downstream of the carrying direction (toward the right side as viewed in the illustration) by the drive for rotation of one of the belt rollers 6 in the clockwise direction (in the direction indicated by an arrow 90).

Presser members 9*a*, 9*b* are disposed at locations where the paper is fed in and out with respect to the belt roller 6. The presser members 9*a*, 9*b* serve to press the paper down on the carrying surface of the carrier belt 8 to hold it thereon, so as to ensure the carriage of the paper on the carrying surface.

A paper releasing mechanism 10 is arranged downstream of the carrying direction (toward the right side as viewed in the illustration) along the paper carrier passage. The paper releasing mechanism 10 is structured to release the paper held on the carrying surface of the carrier belt 8 by the aid of absorption from the carrying surface of the carrier belt 8 and feed it to a paper discharge portion 12 on the right side, Four ink-jet heads 2 have head bodies 2*a* on their lower ends, respectively. The head bodies 2*a* each have a rectangular cross-section. The head bodies 2*a* are disposed adjacent to each other so that their longitudinal dimensions can correspond to the direction orthogonal to the paper carrying direction (vertical direction as viewed in FIG. 1). In other words, this printer 1 is a line printer. Bottoms of the four head bodies 2*a* are opposite to the paper carrier passage, and a number of ink squirting ports or nozzles 13 having a very small diameter (FIGS. 4, 5, 6) are arranged on the bottoms. The four head bodies 2*a* squirt four color inks of magenta, yellow, cyan, and black, respectively.

The head body 2*a* is set in place to define a small space between the lower surface of the head body and the carrying surface of the carrier belt 8, and the paper carrier passage is formed in that space. Accordingly, when paper carried by the carrier belt 8 passes in sequence right under the head bodies 2*a*, the head bodies 2*a* squirt their respective color inks at an upper surface (a printing surface) of the paper to form a desired color image on the paper.

Figure 2A:
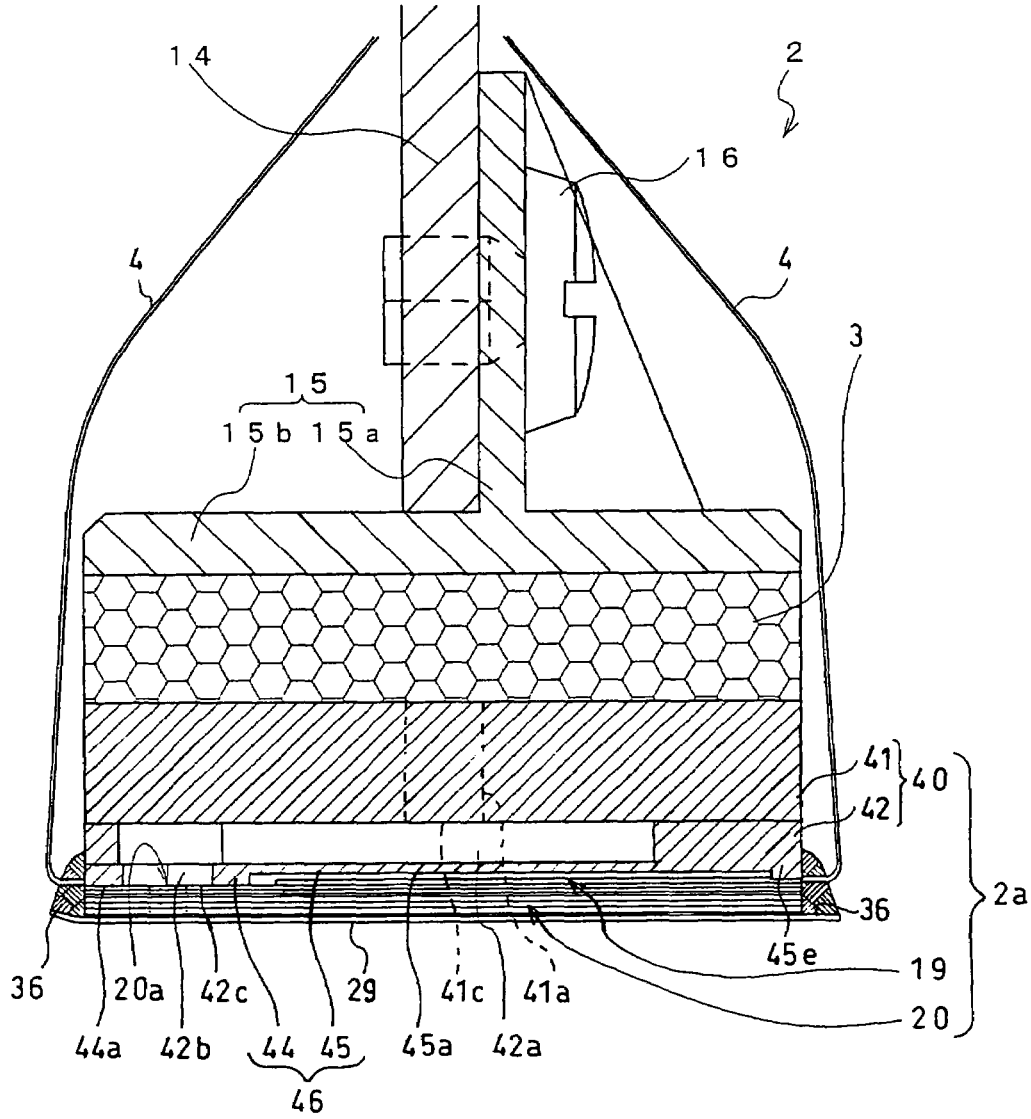
FIG. 2A is a partly cross-sectional view of the ink-jet head shown in FIG. 1.

FIG. 2A shows a partly cross-sectional view of the ink-jet head 2 shown in FIG. 1. The ink-jet head 2 is mounted on an adequate member 14 provided in the printer 1 through a holder 15. The holder 15 is formed in an inverted T-shape having a vertical portion 15*a* and a horizontal portion 15*b*, when viewed from side. The vertical portion 15*a* is mounted on a member 14 by a screw 16, while the head body 2*a* is fixed to a lower surface of the horizontal portion 15*b* of the holder 15 through a spacer 3.

The head body 2*a* includes a passage unit (passage portion) 20 having a number of nozzles 13 formed on a bottom thereof, four actuator units (driving portion) 19 for imparting squirting energy to ink in the passage unit 20 (See FIGS. 3 and 4), and a reservoir unit (protrusion member) 40 for feeding the ink to the passage unit 20. Both the passage unit 20 and the actuator unit 19 have a laminated structure formed by lamination of a plurality of thin sheets. The reservoir unit 40 formed of metal material, such as stainless steel, has substantially the same plane form as the passage unit 20. The actuator unit 19 and the reservoir unit 40 are both bonded to an upper surface of the passage unit 20.

Figure 2B:
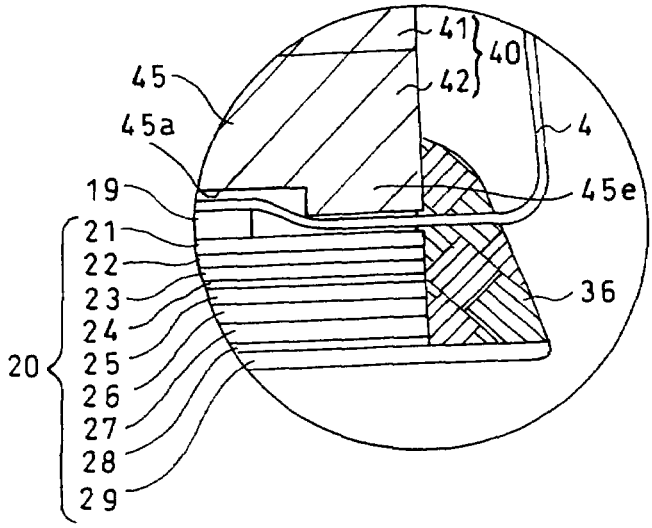
FIG. 2B is a partly enlarged view of a lateral side of a head body shown in FIG. 2A.
Figure 3:
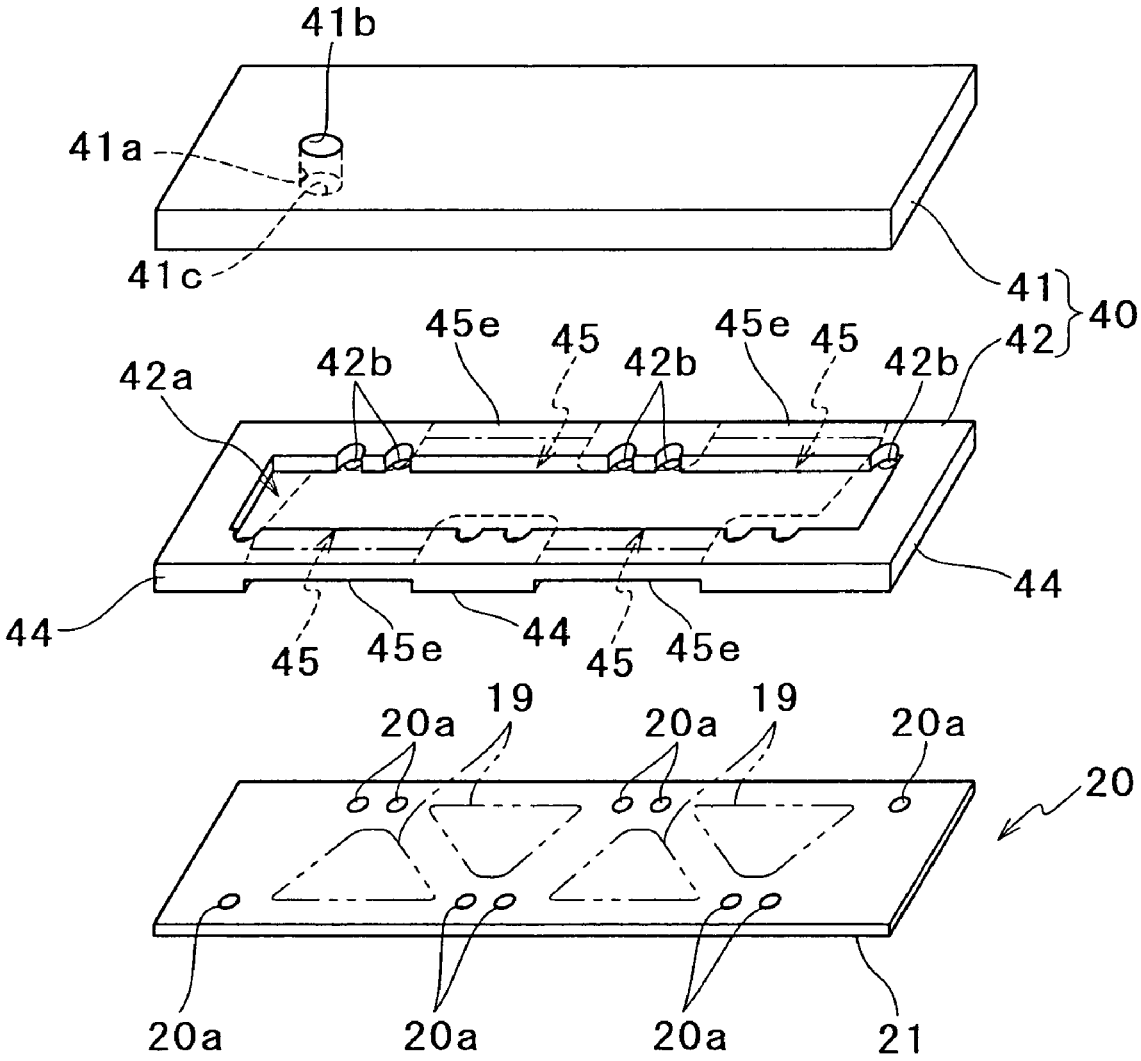
FIG. 3 is an exploded perspective view of the head body shown in FIG. 2A.

Now, reference is made of the construction of the reservoir unit 40, with reference to FIGS. 2A, 2B, and 3.

The reservoir unit 40 is formed by lamination of two places of an upper sheet 41 and a lower sheet 42. The lower sheet 42 has a depressed portion formed in an upper surface thereof. The depressed portion is formed to be enclosed completely by a half-etching. The depressed portion is covered with the upper sheet 41 having a flat lower surface, to define an ink reservoir 42*a*. The ink reservoir 42*a* is a generally rectangular parallelepiped hollow region for storing the ink fed to the passage unit 20. The ink reservoir 42*a* has a generally rectangular planar form extending along a direction of elongation of the head body 2*a*.

In the bottom of the reservoir unit 40 or in the bottom 46 of the lower sheet 42, a bonded portion 44 (a first protrusion) extending downwardly from a surrounding surface is formed in zigzag with respect to the direction of elongation of the reservoir unit 40 by the half-etching. All rears of the bottom 46 but the bonded portion 44 serve as a spaced portion 45 spaced apart from and opposite to the passage unit 20. A front end of the bonded portion 44 serves as a bonded surface 44*a* bonded to the passage unit 20. The bonded portion 44 is bonded to the passage unit 20 while supporting the spaced portion 45 to maintain a distance between the spaced portion 45 and the passage unit 20. The spaced portion 45 includes the ink reservoir 42*a* (See FIG. 2A).

Figure 4:
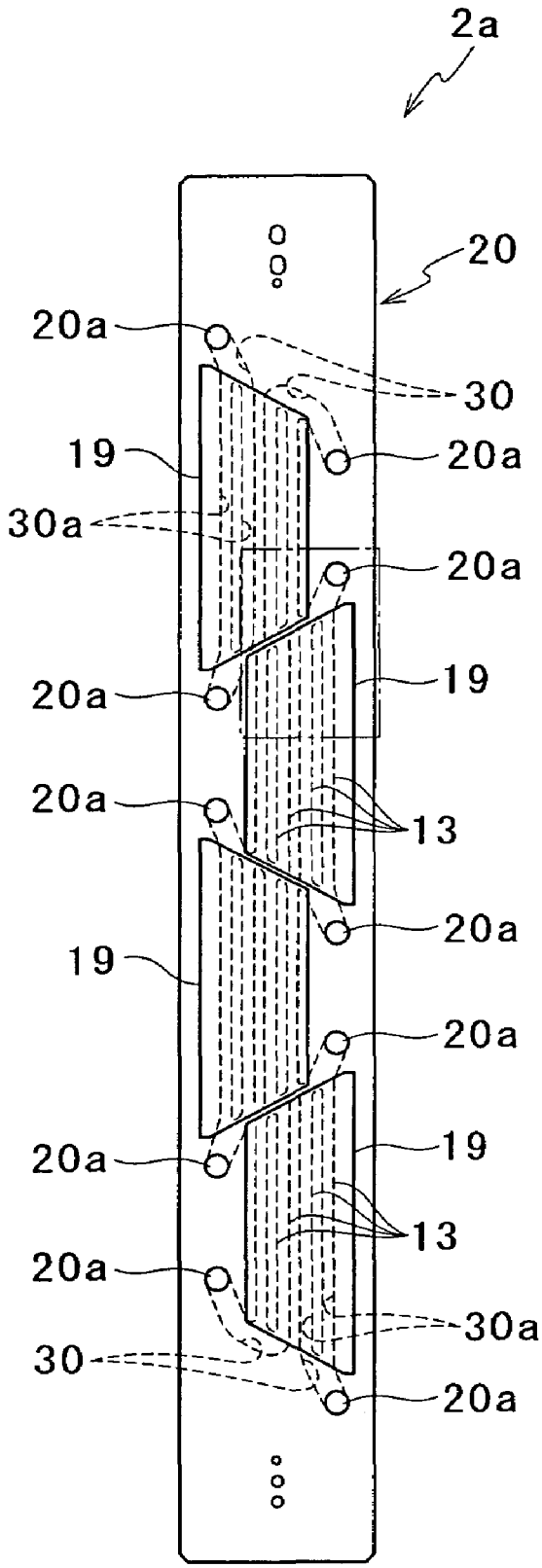
FIG. 4 is a plan view of the head body shown in FIG. 2A.

As shown in FIGS. 3 and 4, four actuator units 19 are staggered on the upper surface of the passage unit 20 in an area thereof opposite to the spaced portion 45. In other words, the reservoir unit 40 has the bonded surface 44*a* bonded to the passage unit 20 and the spaced surface 45*a* (bottom of the spaced portion 45) spaced apart from the actuator unit 19 and extended to bridge over the actuator unit 19. As seen from FIG. 2A, an entire area of each actuator unit 19 is opposite to the spaced portion 45.

Returning to FIG. 2A, flexible printed circuits (FPC) 4 which are power supply members for supplying driving signals to the actuator unit 19 are bonded to an upper surface of the actuator unit 19. Each FPC 4 is drawn out leftwards or rightwards and then drawn upwards along the head body 2*a*.

In FIG. 2B, a lateral side of the head body 2*a* shown in FIG. 2A at a location where the FPC 4 is drawn out is shown in an enlarged form. It is seen from FIG. 2B that a protrusion (a second protrusion) 45*e* projecting in the same direction (downwardly) as the bonded portion 44 is provided in a surface of the spaced portion 45 of the reservoir unit 40 opposite to the passage unit 20 at an end thereof on an opposite side to the bonded portion 44 with respect to the actuator unit 19. In other words, the protrusion 45*e* is located in an area (a first area) which is spaced apart from the bonded surface (44*a*) across an opposite area of the spaced surface (45*a*) of the reservoir unit (40) to the actuator unit (19) and is not opposite to the actuator unit (19). The location where the protrusion 45*e* is provided corresponds to the location where the FPC 4 is drawn out.

Further, as shown in FIG. 2B, the protrusion 45*e* is opposite to the passage unit 20 and also its front end is positioned below the upper surface of the actuator unit 19. The front end of the protrusion 45*e* is spaced apart from the passage unit 20 to provide only a space for FPC 4 to be drawn out. For example in the case where the front end of the protrusion 45*e* and the upper surface of the passage unit 20 are spaced from each other at only a distance equal to a width of the FPC 4, when the bonded portion 44 is bonded to the upper surface of the passage unit 20, there is a possibility that FPC 4 may be brought into contact with the protrusion 45*e*, to cause the bonded portion 44 located on the opposite side to the protrusion 45*e* to rise from the upper surface of the passage unit 20. Accordingly, in the illustrated embodiment, the front end of the protrusion 45*e* and the upper surface of the passage unit 20 are spaced from each other at only a distance slightly larger than the width of the FPC 4, in order to avoid the problem mentioned above.

A silicon-based adhesive (i.e., a sealing member) 36 is mounded on the lateral side of the head body 2*a* at the location where FPC 4 is drawn out. The adhesive 36 serves to fix the FPC 4 to the reservoir unit 40; reinforce it; and prevent the irk and the like from entering into an interior of the head 2 from the space between the FPC 4 and the reservoir unit 40.

Further it is seen from FIG. 2B that the FPC 4 is in contact with at least a part of the protrusion 45*e*. This can allow the positioning of the FPC 4 relative to the head body 2*a* with comparative ease, and as such can allow the FPC 4 to be fixed more stably.

Next, reference is made of the flow of ink through the head body 2*a*. As shown in FIGS. 2A and 3, the upper sheet 41 of the reservoir unit 40 is provided with an ink supply passage 41*a* extending through the upper sheet 41 vertically formed at a location near one end thereof with respect to the direction of elongation of the upper sheet 41. The ink supply passage 41*a* communicates between a supply port 41*b* formed in the surface of the reservoir unit 40 and an inlet 41*c* of the ink reservoir 42*a*. The ink supplied from an ink tank (not shown) to the head body 2*a* enters into the ink supply passage 41*a* from the supply port 41*b* and arrives at the ink reservoir 42*a*. In this embodiment, since the inlet 41*c* is formed at a location near one end thereof with respect to the direction of elongation of the ink reservoir 42*a*, the ink, when entering into the ink reservoir 42*a* from the inlet 41*c*, flows through the ink reservoir 42*a* toward the other end with respect to the direction of elongation of the ink reservoir.

As shown in FIGS. 2A and 3, the lower sheet 42 of the reservoir unit 40 is provided with ten connecting passages 42*b* for connecting between the ink reservoir 42*a* and the bottom of the reservoir unit 40. Connecting ports 42*c* (FIG. 2A) which are openings of the connecting passages 42*b* facing the passage unit 20 are formed at locations to connect with the connecting ports 20*a* in the upper surface of the passage unit 20. The ink in the ink reservoir 42*a* is supplied to the passage unit 20 through the ten connecting passages 42*b* and the ten connecting ports 20*a*. The ink supplied to the passage unit 20 is ejected or squirted from the nozzles 13.

FIG. 4 is a plan view of the head body 2*a* from which the reservoir unit 40 is excluded. The passage unit 20 has a generally rectangular plan form extended in one direction (in a main scanning direction). In FIG. 4, manifold channels 30 which are common ink chambers arranged in the passage unit 20 are depicted in broken lines. The ink is supplied from the ink reservoir 42*a* of the reservoir unit 40 into the manifold channels 30 through the ten connecting ports 20*a* arranged in the upper surface of the passage unit 20. The manifold channels 30 are branched into a plurality of sub-manifold channels 30*a* extending in parallel with the direction of elongation of the passage unit 20. The ten connecting ports 20*a* are arrayed in two lines along the direction of elongation of the head body 2*a*, five connecting ports 20*a* for each line.

Four actuators 19 having a trapezoid planar form are staggered in two lines in such a manner as to pass over the connecting ports 20*a* and are adhesive bonded to the upper surface of the passage unit 20. The actuator units 19 are disposed so that their parallel and opposite sides (upper side and lower side) run along the direction of elongation of the passage unit 20. Oblique lines of adjacent actuator units 19 are partly overlapped with each other in a width wise direction of the passage unit 20.

A bottom of the passage unit 20 opposite to the adhesive bonded area of the actuator unit 19 serves as an ink squirting area where a number of nozzles 13 are arranged in matrix. Groups of pressure chambers in which a number of pressure chambers 34 are arranged in matrix are formed in the surface of the passage unit 20 opposite to the actuator unit 19 (See FIG. 5).

Figure 5:
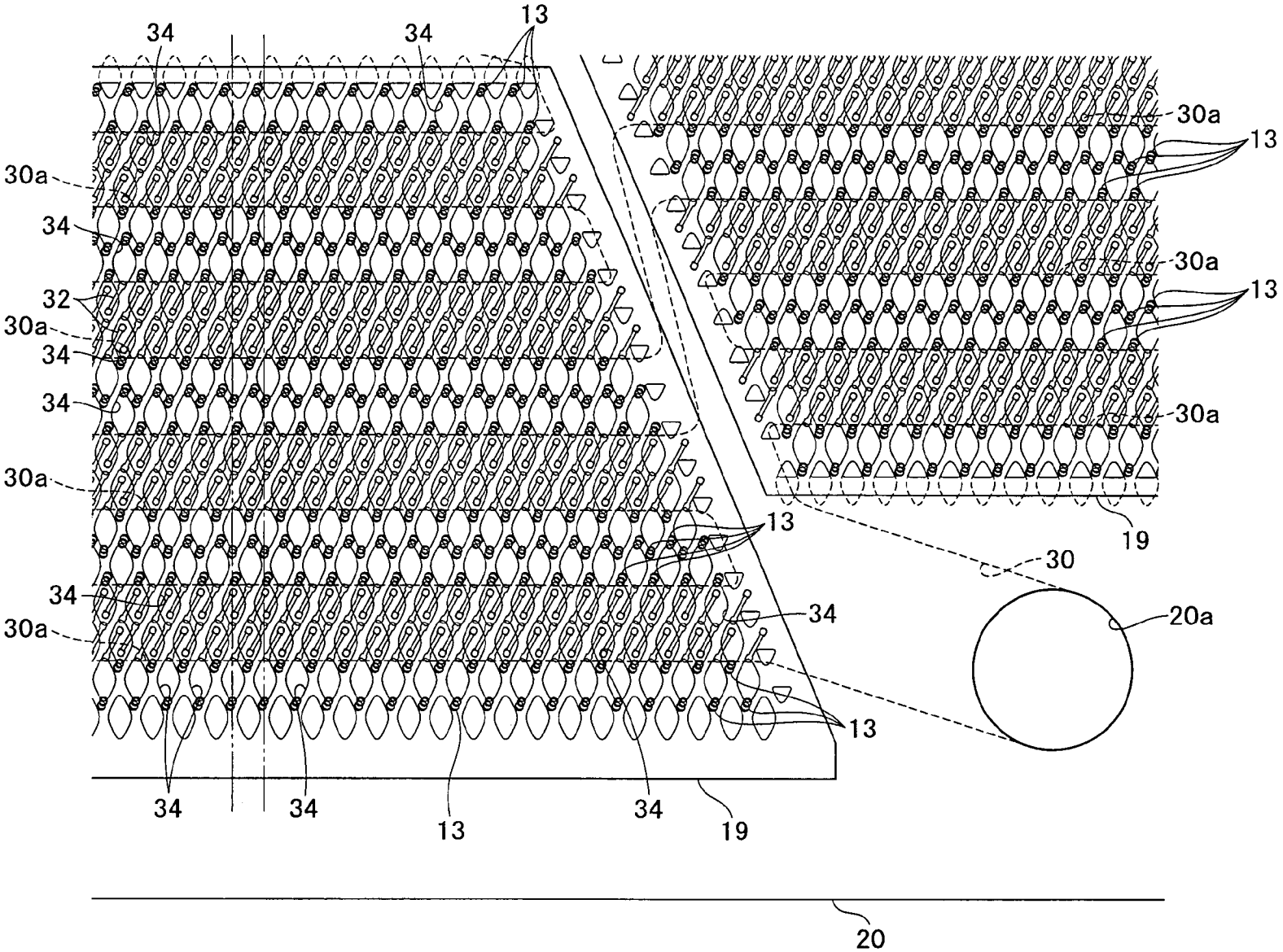
FIG. 5 is an enlarged view of an area surrounded by a dashed line of FIG. 4.
Figure 6:
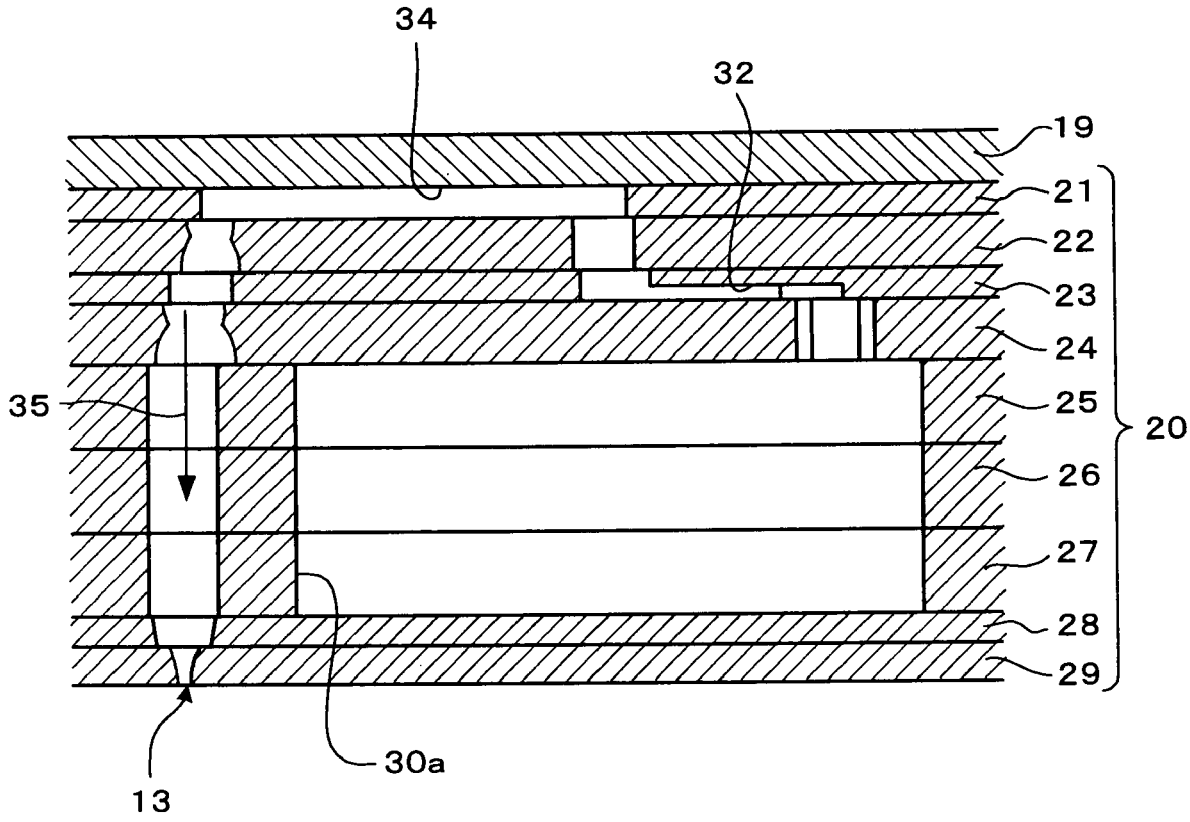
FIG. 6 is a partly cross-sectional view corresponding to a pressure chamber of the head body shown in FIG. 4.

FIG. 5 is an enlarged view of an area surrounded by a dashed line of FIG. 4. As shown in FIG. 5, the passage unit 20 opposite to the actuator unit 19 includes four sub-manifold channels 30*a* extending in parallel with the direction of elongation of the passage unit 20. The sub-manifold channels 30*a* connect with a number of individual ink passages 35 running from outlets of the sub-manifold channels to the nozzles 13 (See FIG. 6). FIG. 6 is a cross-sectional view showing the individual ink passage 35. As seen from FIG. 6, each nozzle 13 communicates with the sub-manifold channel 30*a* through the pressure chamber 34 and an aperture 32. Thus, in the head body 2*a*, each pressure chamber 34 has the individual ink passage 35 running from the outlet of the sub-manifold passage 30*a* to the nozzle 13 through the aperture 32 and the pressure chamber 34.

As seen from FIG. 6 as well, the head body 2*a* with the exclusion of the reservoir unit 40 has a laminated structure wherein a total of ten sheet materials are laminated in the order of the actuator unit 19, a cavity plate 21, a base plate 22, an aperture plate 23, a supply plate 24, manifold plates 25, 26, 27, a cover plate 28, and a nozzle plate 29. The passage unit 20 is formed from nine sheet sheets of these ten sheet materials with the exclusion of the actuator unit 19.

In the actuator unit 19, four piezoelectric sheets 51–54 (FIG. 8) are laminated and electrodes are arranged, as detailed later. Of these piezoelectric sheets, only an uppermost layer is in the form of a layer having an active layer portion that becomes an active layer when electric field is applied thereto (which is hereinafter simply referred to as "the layer having the active layer") and the three remaining layers are in the form of a non-active layer. The cavity plate 21 is a metal plate having a number of generally diamond-shaped holes defining the space of the pressure chamber 34 which are formed in an adhesive bonded area of the actuator unit 19. The base plate 22 is a metal plate having a communicating hole for communicating from the pressure chamber 34 to the aperture 32 and a communicating hole for communicating from the pressure chamber 34 to the nozzle 13 which are formed for each pressure chamber 34 of the cavity plate 21.

The aperture plate 32 is a metal plate having a communicating hole for communicating from the pressure chamber 34 to the nozzle 13 in addition to a hole serving as the aperture 32 are formed for each pressure chamber 34 of the cavity plate 21. The supply plate 24 is a metal plate having a communicating hole for communicating between the aperture 32 and the sub-manifold channel 30*a* and a communicating hole for communicating from the pressure chamber 34 to the nozzle 13 are formed for each pressure chamber 34 of the cavity plate 21. Each of the manifold plates 25, 26, 27 is a metal plate having a communicating hole for communicating from the pressure chamber 34 to the nozzle 13 in addition to the sub-manifold channel 30*a* are formed for each pressure chamber 34 of the cavity plate 21. The cover plate 28 is a metal plate having a communicating hole for communicating from the pressure chamber 34 to the aperture 32 formed for each pressure chamber 34 of the cavity plate 21. The nozzle plate 29 is a metal plate having the nozzle 13 formed for each pressure chamber 34 of the cavity plate 21.

These ten sheets 19, 21–29 are aligned and laminated each other so that the individual ink passage 35 can be formed, as shown in FIG. 6. The individual ink passage 35 extends upwards from the sub-manifold channel 30*a*, first, and then extends horizontally in the aperture 32. Then, it extends further upwards therefrom and then extends horizontally again in the aperture 32. Then, it extends obliquely downwards in a direction of being away from the aperture 32 and then extends vertically downwards to the nozzle 13.

As apparent from FIG. 6, the pressure chamber 34 and the aperture 32 are positioned at different level. This enables the aperture 32 communicating to one pressure chamber 34 in the passage unit 20 opposite to the actuator unit 19 to be arranged at the same position as an adjacent pressure chamber 34 and overlapped each other, when viewed from the top plan, as shown in FIG. 6. This enables the pressure chambers 24 to be disposed closely at a high density, thus enabling an image to be printed with high resolution by the ink-jet head 1 having a relatively small occupation area.

Returning to FIG. 5, the groups of pressure chambers each comprising a number of pressure chambers 34 are formed in the adhesive bonded area of the actuator unit 19. The group of pressure chambers have a trapezoid form having substantially the same size as the adhesive bonded area of the actuator unit 19. The group of pressure chambers are formed for each actuator unit 19.

As apparent from FIG. 5, the each pressure chamber 34 belonging to the groups of pressure chambers is communicated to the nozzle 13 at one end of a long diagonal line thereof and is communicated to the sub-manifold channel 30*a* through the aperture 32 at the other end of the long diagonal line. As mentioned later, individual electrodes 45 (FIGS. 7, 8) having a generally planar diamond form and slightly smaller than the pressure chamber 34 are arranged in matrix on the actuator unit 19 in such a manner as to be opposite to the pressure chambers 34. In FIG. 5, the nozzles 13, pressure chambers 34 and apertures 32 in the passage unit 20 which should be depicted in a broken line are depicted in a solid line, for the purpose of easy understanding of the illustration.

Next, reference is made of the construction of the actuator unit 19. A number of individual electrodes 56 (FIGS. 7, 8) are arranged in matrix on the actuator unit 19 to have the same pattern as in the pressure chamber 34. The individual electrodes 56 are arranged in the positions opposite to the pressure chambers 34, when viewed from the top plan.

Figure 7:
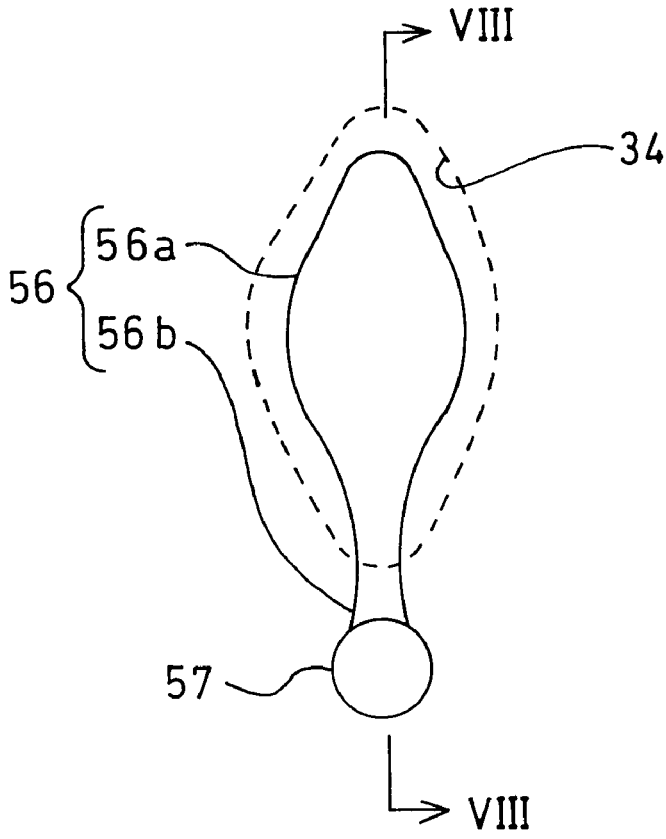
FIG. 7 is a plan view of an individual electrode formed on an actuator unit depicted in FIG. 6.

FIG. 7 is a plan view of the individual electrode 56. As shown in FIG. 7, the individual electrode 56 comprises a main electrode area 56*a* to be arranged in an opposite position to the pressure chamber 34, when viewed from top, so as to be accommodated therein the pressure chamber 34 and an auxiliary electrode area 56*b* communicating to the main electrode area 56*b* and arranged in an opposite position to an outside of the pressure chamber 34.

Figure 8:
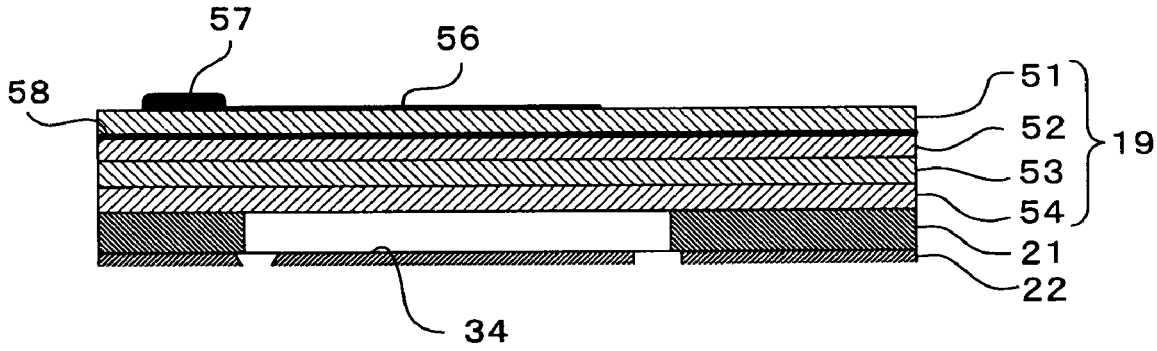
FIG. 8 is a partly cross-sectional view of the actuator unit depicted in FIG. 6 taken along line VIII—VIII of FIG. 7.

FIG. 8 is a partly cross-sectional view of the actuator unit depicted in FIG. 6 taken along line VIII—VIII of FIG. 7. As shown in FIG. 8, the actuator unit 19 includes four piezoelectric sheets 51, 52, 53, 54 formed to have the same thickness of the order of 15 μm. These piezoelectric sheets 51–54 are formed into a layered continuous flat plate (continuous flat plate layer) to be arranged over a number of pressure chambers 34 formed in one ink squirting area in the head body 2*a*. As a result of the piezoelectric sheets 51–54 being arranged in the form of the continuous flat plate layer over a number of pressure chambers 34, the individual electrodes 56 can be arranged on the piezoelectric sheet 51 at a high density by using a screen printing technique, for example. Therefore, the pressure chambers 34 formed at the corresponding positions to the individual electrodes 56 can also be arranged at such a high density that an image can be printed with high resolution. The piezoelectric sheets 51–54 are made of lead zirconate titanate (PZT) ceramic material having ferroelectricity.

The main electrode area 56*a* of the individual electrode 56 formed on the uppermost layer of the piezoelectric sheet 51 has a generally diamond planar form similar to the form of the pressure chamber 34, as shown in FIG. 7. The main electrode area 56*a* of a generally diamond form has a lower acutely-angled portion connected to the auxiliary electrode area 56*b* opposite to the outside of the pressure chamber 34. The auxiliary electrode area 56*b* is provided, at its end, with a circular land portion 57 which is electrically connected with the individual electrode 56. As shown in FIG. 8, the land portion 57 is opposite to the area where no pressure chamber 34 is formed in the cavity plate 21. The land portion 57 is made of gold including glass frit, for example, and is formed on a surface of an extended area of the auxiliary electrode area 56*a*, as shown in FIG. 7. The land portion 57 is electrically connected with a contact point in the FPC 4, though the FPC 4 is omitted from the illustration of FIG. 8. When the land portion is bonded to the auxiliary electrode area 56*a*, the contact point of the FPC 4 must be pressed against the land portion 57. Since the pressure chamber 34 is not formed in the area of the cavity plate 21 opposite to the land portion 57, the contact point of the FPC 4 can be pressed against the land portion 57 with sufficient pressing force to ensure the bonding.

A common electrode 58 having the same outer shape as the piezoelectric sheet 52 and a thickness of about 2 μm is interposed between the uppermost layer of piezoelectric sheet 51 and the piezoelectric sheet 52 immediately under the uppermost layer. The individual electrode 56 and the common electrode 58 are both formed of metal material such as Ag—Pd-based metal.

The common electrode 58 is connected to ground in an area not shown and thereby the common electrode 58 is kept at a ground potential equally in all area corresponding to the pressure chambers 34. Also, the individual electrodes 56 are connected to the driver IC (not shown) through the FPC 4 including different independent lead lines for their respective pressure chambers 56 and the land portion 57 so that the potential can be controlled for the respective individual electrodes 56 corresponding to the pressure chambers 34.

Next, reference is made of the driving method of the actuator unit 19. A polarization direction of the piezoelectric sheet 51 of the actuator unit 19 corresponds to a thickness direction thereof. That is to say, the actuator unit 19 has a so-called unimorph structure wherein one upper piezoelectric sheet 51 (positioned to be away from the pressure chamber 34) is in the form of the layer having the active layer and three lower piezoelectric sheets 52–54 are in the form of a non-active layer. Accordingly, when the individual electrode 56 is set at a predetermined positive or negative potential, for example, if the direction of the electric filed and that of the polarization are the same, the area of the piezoelectric sheet 51 sandwiched between the electrodes acts as the active layer (pressure generating portion), so that the actuator unit is crimped in a direction orthogonal to the polarization direction by the piezoelectric transversal effect.

In this embodiment, the area of the piezoelectric sheet 51 sandwiched between the main electrode area 56*a* and the common electrode 58, to which the electric field is applied, acts to the active layer. Accordingly, the area of the piezoelectric sheet 51 sandwiched between the main electrode area 56*a* and the common electrode 58 is crimped in the direction orthogonal to the polarization direction by the piezoelectric transversal effect.

On the other hand, since the piezoelectric sheets 52–54 are not influenced by the electric field, they are not deformed spontaneously. This causes difference in distortion in the direction orthogonal to the polarization direction between the upper layer of piezoelectric sheet 51 and the lower layers of piezoelectric sheets 52–54. As a result, the entire piezoelectric sheets 51–54 are tried to deform in such a manner as to protrude toward the non-activity layer side (Unimorph deformation). At this time, as a result of the lower surface of the piezoelectric sheets 51–54 being fixed to the upper surface of the partition (cavity plate) 21 for defining the pressure chamber 34, as shown in FIG. 6, the piezoelectric sheets 51–54 are deformed in such a manner as to protrude toward the pressure chamber side. Due to this, the volume of the pressure chamber 34 is reduced to cause an increased pressure against the ink, thus causing the ink to be squirted from the nozzle 13. After that, when the individual electrode 58 is returned to the same potential as the common electrode 58, the piezoelectric sheets 51–54 are turned to their original forms and the volume of the pressure chamber 34 is returned to their original volume, so that the ink is sucked from the sub-manifold channel 30*a* side.

Another driving method may be taken. For example, the individual electrode 56 is previously kept at a different potential from that of the common electrode 58 and is set at the same potential as that of the common electrode 58 for a while upon each ink squirting request and, thereafter, is set again at the different potential from that of the common electrode 58. In this method, when the piezoelectric electrodes 51–54 are restored into their original forms at the timing when the individual electrode 56 and the common electrode 58 come to be the same potential, the volume of the pressure chamber 34 is increased, as compared with the initial state (the state in which the both electrodes are different in potential from each other), so that the ink is sucked into the pressure chamber 34 from the sub-manifold channel 30*a* side. Thereafter, the piezoelectric sheets 51–54 are deformed to protrude toward the pressure chamber side at the timing when the individual electrode 56 is set at a different potential from that of the common electrode 58. Due to this, the volume of the pressure chamber 34 is reduced to cause an increased pressure against the ink, thus causing the ink to be squirted.

Next, reference is made of the producing method of the ink-jet head 2 of this embodiment. Reference is herein made of the producing method of only the head body 2*a* shown in FIG. 2A.

The passage unit 20 of the head body 2*a* is produced in the following way. The plates are etched with patterned photoresists as masks, to form openings and recessed portions are formed in the respective plates 21–29, as shown in FIG. 6.

Thereafter, the nine plates 21–29 are laminated and bonded to each other while adhesive is interposed between adjacent plates, to form the individual ink passage 35 as shown in FIG. 6, to thereby produce the passage unit 20.

On the other hand, the actuator unit 19 is produced in the following way. First, a pattern of a conductive paste serving as the common electrode 58 is printed on a green sheet of ceramic material serving as the piezoelectric sheet 52. Then, the four piezoelectric sheets 51–54 are aligned with a jig and laminated to form a laminated member, and the laminated member thus formed is baked at a predetermined temperature. Then, the laminated member thus formed having no individual electrode 56 is adhesive bonded to the passage unit 20 to put the piezoelectric sheet 54 and the cavity plate 21 into contact with each other. Thereafter, a pattern of a conductive paste serving as the individual electrode 56 is printed on a surface of the piezoelectric sheet 51 and further a pattern of a conductive paste serving as the land portion 57 is printed at one end of the conductive paste serving as the individual electrode 56. Thereafter, it undergoes a baking process to bake the paste. After this manner, the individual electrode 56 is formed on the surface of the piezoelectric sheet 51 and further the land portion 57 is formed on the auxiliary electrode area 56*b* of the individual electrode 56 at one end thereof.

Thereafter, the actuator unit 19 and the FPC 4 are bonded to each other by pressing the contact point of the FPC 4 against the land portion 57 in heating condition, after each contact point of the FPC 4 is positioned with a corresponding land portion 57. The FPC 4 bonded to the upper surface of the actuator unit 19 is drawn out leftwards or rightwards of the head 2 and then is raised up along the head body 2*a*, as shown in FIGS. 2A and 2B. Further, it is connected with the driver IC (not shown) fixed to a lateral side of the member 14, thus enabling the driving signals to be supplied to the individual electrode 56.

On the other hand, the reservoir unit 40 is produced by two plates of the upper plate 41 and the lower plate 42 being laminated and bonded to each other.

Reference is herein made of the method for forming concavity and convexity in the bottom 46 of the lower plate 42, in particular. First, the bottom of the lower plate 42 is etched by the first half-etching in the state in which its portion corresponding to the bonded surface 44*a* of the bonded portion 44 is masked. In this stage, the recessed portion having a length for the protrusion 45*e* to be protruded, or a depth for the FPC 4 to be drawn out, is formed in all areas of the lower plate 42 except the area corresponding to the bonded surface 44*a* of the bottom of the lower plate 42. Then, a portion of the lower plate corresponding to the front end surface of the protrusion 45*e* is further masked, with the portion corresponding to the bonded surface 44*a* masked, and then the bottom of the lower plate 42 is etched by the second half-etching in this state. As a result, the recessed portion having a depth for the actuator unit 19 to be disposed is formed in the area of the spaced portion 45, except the protrusion 45*e*, as shown in FIG. 2A. At the same time as this, the protrusion 45*e* is formed. The bonded portion 44 is formed in the masked portions in the two half-etching processes in total.

The reservoir unit 40 thus produced is bonded to the upper surface of the passage unit 20 in such a manner that the bonded surface 44*a* and the spaced surface 45*a* in the bottom 46 and the actuator unit 19 bonded to the upper surface of the passage unit 20 have the positional relationship as shown in FIG. 2A. In this positional relationship, a space, which does not suppress the deformation of the actuator unit 19, is formed between the actuator unit 19 and the spaced surface 45*a*. Further, between the upper surface of the passage unit 20 and the protrusion 45*e*, formed is a space, which prevents ink or the adhesive 36 having fluidity from entering into the head 2 while allowing the FPC 4 to be withdrawn outside of the head 2.

As mentioned above, according to the ink-jet head 2 of this embodiment, the bonded portion 44 is presented at one side of the actuation unit 19 and the protrusion 45*e* is presented at the other side, as shown in FIG. 2A. While a construction having no protrusion 45*e* can allow an easy entry of the ink into the head 2 from the other side, the construction of the invention having the protrusion 45*e* can prevent the entry of the ink into the head 2 by the protrusion 45*e*. Thus, the construction of the invention can prevent the adhering of the ink to the actuator unit 19, thus releasing or minimizing the problem of reduction of the ink squirting capability of the actuator unit.

Also, when the adhesive 36 is used as in this embodiment, since the adhesive 35 has comparatively large fluidity before solidified, it enters into the space between the FPC 4 and the reservoir unit 40 with ease. However, the provision of the protrusion 45*e* serves to prevent the entry of the adhesive 36 into the head 2 and the adherence to the actuator unit 19. Thus, when the adhesive 36 is used for fixing the FPC 4 to the reservoir unit 40 or the passage unit 20, the protrusion 45*e* prevents the adhering of the adhesive 36 to the actuator unit 19, thus minimizing the problem of reduction of the ink squirting capability of the actuator unit.

Moreover, because the FPC 4 is partly in contact with both of the upper surface of the passage unit 20 and the protrusion 45*e*, a space between the upper surface of the passage unit 20 and the protrusion 45*e* is minimized. Accordingly, by disposing the adhesive 36, the advantage of preventing the entry of ink or the adhesive 36 having fluidity into the head 2 and also the advantage of preventing the adhering of the ink or the adhesive 36 to the actuator unit 19 are more effectively achieved.

Specifically, in the construction in which the pressure chambers 34 are arranged in matrix and the individual electrodes 56 of the actuator unit 19 are arranged opposite to the respective pressure chambers 34, so that the FPC 4 supplies driving signals to the individual electrodes 56, as in the construction of the illustrated embodiment, it is general that the FPC 4 is bonded in the interior of the head body 1*a* and is drawn out over the head 2 (See FIGS. 2A and 2B). In this construction in particular, the adhesive 36 enters into the head 2 easily. However, even in this construction, the entry of the adhesive 36 into the head 2 can be well prevented by the protrusion 45*e*.

Also, the protrusion 45*e* is provided in the reservoir unit 40 forming the head body 1*a*, not in an additional member other than the head body 1*a*. Thus, the effect mentioned above can be obtained with a comparatively simple construction and without increasing the parts count.

Further, since a width of the passage unit 20 is not more than a width of the reservoir unit 40 and the protrusion 45*e* formed in the reservoir unit 40 is opposite to the passage unit 20 and also the front end of the protrusion 45*e* is positioned below the upper surface of the actuator unit 19, as shown in FIG. 2B, the effects mentioned above can be obtained while the head 2 can also be reduced in width, as compared with a variant (FIG. 9) as mentioned later.

Also, the entire actuator unit 19 is opposite to the spaced portion 45 of the reservoir unit 40. For example if a part of the actuator unit 19 is located in a position where it is not opposite to the spaced portion 45, there is a possibility that the ink may adhere to the part of the actuator unit 19. However, in the construction of this embodiment, since the entire actuator unit 19 is opposite to the spaced portion 45, the effect of preventing the adhering of the ink to the actuator unit 19 provided by the protrusion 45*e* can be surely achieved.

As the FPC 4 is fixed to both of the protrusion 45*e* and the passage unit 20 facing the protrusion 45*e* by the adhesive 36, even if some external force is added to the FPC 4, reliability of electrical connection between the FPC 4 and the actuator unit 19 is ensured.

Further, according to the producing method of the ink-jet head 2 according to this embodiment, since the bonded portion 44 and the protrusion 45*e* are both formed by the half-etching when the concavity and convexity is formed in the bottom 46 of the lower plate 42, the production cost can be reduced.

Figure 9A:
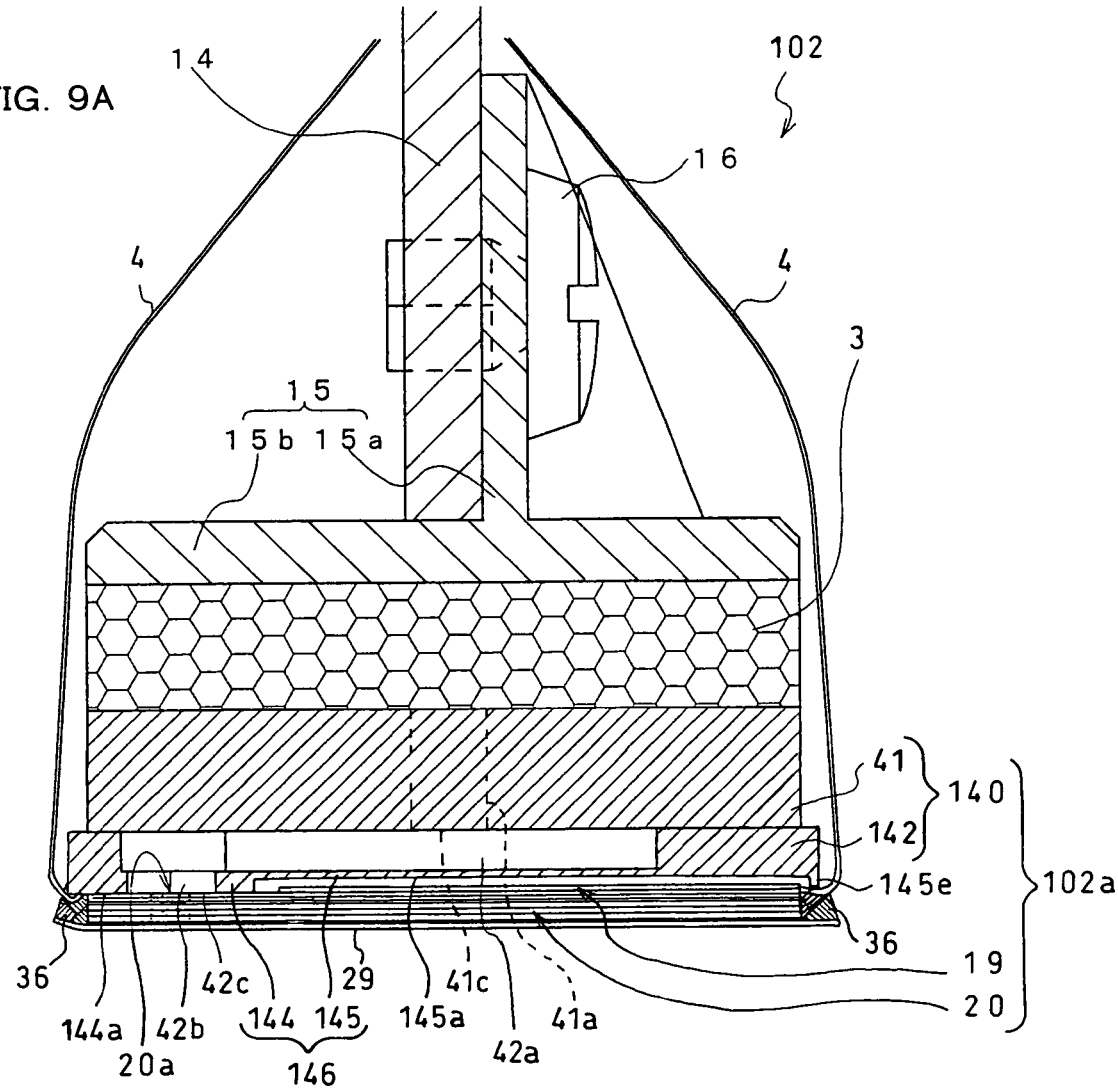
FIG. 9A is a partly cross-sectional view of a variant of the ink-jet head according to the present invention, which corresponds to FIG. 2A.
Figure 9B:
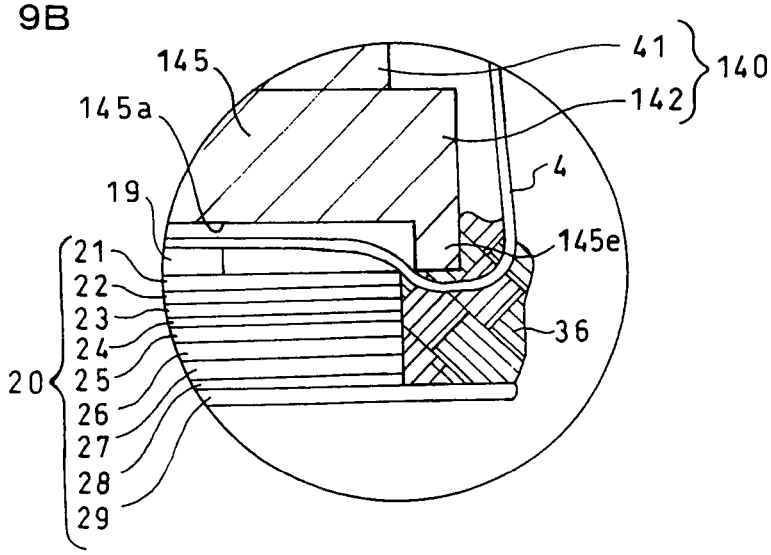
FIG. 9B is a partly enlarged view of a lateral side of the head body shown in FIG. 9A.

Reference is now made of a variant of the ink-jet head according to the present invention. FIGS. 9A and 9B are views showing the ink-jet head of the variant, which correspond to FIGS. 2A and 2B. This variant differs from the embodiment mentioned above only in the construction of the reservoir unit or rather in the construction of the lower plate, and the remaining constructions are the same as those of the embodiment illustrated above. Accordingly, the description of the corresponding construction is omitted, while like reference numerals are labeled to corresponding parts.

As shown in FIG. 9A, the reservoir unit 140 of the ink-jet head 102 according to this variant is formed by laminating the upper plate 41 and the lower plate 142 having a larger width than the upper plate 41. The lower plate 142 is provided with the ink reservoir 42*a* and the connecting passage 42*b* (FIG. 4) identical with those of the embodiment mentioned above. On the other hand, the lower plate 142 has a bonded portion (first protrusion) 144 and a spaced portion 145 formed on the bottom 146 by the half-etching.

The bonded portion 144 has a width with respect to a lateral direction of the head larger than that of the bonded portion 44 of the embodiment illustrated above (See FIG. 2A). Accordingly, a bonded surface 144*a* of the front end of the bonded portion 144 is not bonded to the upper surface of the passage unit 20 at one end thereof with respect to the lateral direction of the head. On the other hand, the spaced portion 145 has a protrusion (second protrusion) 145*e* protruding in the same direction as the bonded portion 144 (i.e., downwardly) which is formed in its opposite surface to the passage unit 20 at an end thereof opposite to the bonded portion 144 with respect to the actuator unit 19. As shown in FIG. 9B, the protrusion 145*e* of this variant is not opposite to the passage unit 20 and also the front end of the protrusion is positioned below the upper surface of the passage unit 20. The spaced surface 145*a* of the spaced portion 145 has a width larger than the spaced surface 45*a* illustrated above and includes a portion that is not opposite to the passage unit 20, as shown in FIG. 9B. Also, it is seen from FIG. 9B that the FPC 4 is in abutment with at least a part of the protrusion 145*e*, as is the case with the embodiment illustrated above.

Although depending on rigidity of the FPC 4, protruding length of the protrusion 145*e*, and the like, the FPC 4 withdrawn through the space between the passage unit 20 and the protrusion 145*e* is bended as in FIG. 9B and is surely in abutment with both of the protrusion 145*e* and an end portion of the passage unit 20. Thereby, the entry of ink, the adhesive 36 and the like into the head 2 is more effectively prevented.

The ink-jet head 102 of this variant can provide the same effects as those of the embodiment illustrated above by the same construction as that of the embodiment illustrated above and can further provide the following effects. First, since the front end of the protrusion 145*c* is positioned below the upper surface of the passage unit 20, the effect of preventing the entry of the ink or the adhesive into the head 102 can be provided effectively, as compared with the ink-jet head 2 of the embodiment illustrated above. Thus, the adhering of the ink, the adhesive and the like to the actuator unit 19 can be prevented more reliably. The farther the protrusion 145*e* protrudes, the more reliably the effect mentioned above can be achieved.

When the ink-jet head 102 of this variant is produced, or particularly when the concavity and convexity of the bottom 146 of the reservoir unit 140 is formed, the bonded portion 144 and the protrusion 145*a* can be both formed by the first half-etching. To be more specific, since the front end of the bonded portion 144 and the front end of the protrusion 145*a* are positioned at the same level, as shown in FIG. 9A, the bottom of the lower plate 142 can be etched by the half-etching in the state in which its portions corresponding to the bonded surface 144*a* and the front end surface of the protrusion 145*e* are masked, to form the recessed portion having the spaced surface 145*a* as the bottom. All areas of the bottom of the lower plate 142 except the recessed portion are presented in the form of the bonded portion 144 and the protrusion 145*e*. This can provide reduction in number of processes and thus in production costs.

The concavity and convexity of the reservoir unit 40, 140 may be formed in any proper methods, such as resin molding or cutting, without limitation to the half-etching.

Also, the protrusion may be provided in the passage unit 20, rather than in the spaced portion 45, 145. In this case, the protrusion may be provided at a width end of the passage unit 20 of the cavity plate 21 forming the uppermost layer of the passage unit 20 in such a manner as to protrude upwardly. In this configuration, in case a protruding length of the protrusion is the same as the height of the actuator unit 19, the FPC 4 connected to the actuator unit 19 need not to be excessively bended. Therefore, such an advantage is obtained in addition to the above-mentioned advantage, that reliability of electrical connection between the actuator unit 19 and the FPC 4 is enhanced. Moreover, although depending on a size of the space between the spaced portion and the passage unit 20, another protrusion is preferably provided on the separated portion so that the another protrusion faces the protrusion formed on the passage unit 20, from the viewpoint of preventing the entry of ink, the adhesive 36, and the like into the head 2. The protrusion may be provided in a area of the passage unit 20 not facing the spaced portion 45, 145 so that a tip of the protrusion is placed upper of a level of the spaced portion 45, 145. In this case, the FPC 4, which is withdrawn outside with bended so as to pass a spaced between the protrusion and the spaced portion, is in abutment with both of the protrusion and the spaced portion. Thereby, the entry of ink, the adhesion 8, and the like into the head 2 is more effectively prevented.

Further, the spaced portion spaced apart from and opposite to the passage unit 20 may be formed by another component, without limitation to the bottom of the reservoir unit 40, 140, and the protrusion may be formed in that member.

Also, the driving portion for imparting squirting energy to the ink in the pressure chambers 34 is not limited to the member, like the actuator unit 19, bonded to the passage unit 20 to be opposite to the pressure chambers 34. For example, the vibrating plate, spaced apart from the driving portion, for defining the pressure chamber, like the vibrating plate of the capacitance type ink-jet head, may also be used as the driving portion. This means that the present invention is also applicable to the structure that the driving portion is bonded to the spaced portion.

The pressure chamber 34 need not necessarily be arranged in matrix. Also, the FPC 4 need not necessarily be constructed to supply driving signals to the respective individual electrodes 56 of the actuator unit 19.

The FPC 4 may be in abutment with the passage unit 20, rather than the protrusion 45*e*, 145*e*, or may be in abutment with neither of them.

Further, the present invention is applicable, for example, to a serial printing type ink-jet printer wherein the head body 2*a* is moved in reciprocation in a direction orthogonal to the paper carrying direction for printing, as well as a line printing type ink-jet printer wherein the paper is carried with respect to the fixed head body 2*a*, 102*a* for printing, like the ink-jet head of the illustrated embodiments.

Also, the present invention is also applicable, for example, to an ink-jet type facsimile or copy machine, without limitation to the ink-jet printer.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head, comprising:

a passage portion in which a plurality of ink ejecting nozzles are formed, the passage portion including a plurality of individual ink passages running to the nozzles through pressure chambers;

a spaced portion spaced apart from and facing the passage portion;

a driving portion bonded to a surface of the passage portion facing the spaced portion for imparting squirting energy to ink in the pressure chambers;

a power supply member electrically connected with the driving portion for supplying driving signals to the driving portion;

a protrusion provided in at least either of the surface of the spaced portion facing the passage portion and the surface of the passage portion facing the spaced portion; and a sealing member disposed adjacent to the protrusion for sealing a space between the passage portion and the spaced portion, wherein the sealing member is on a lateral side of the ink-jet head at a location where the power supply member is drawn out.

2. The ink-jet head according to claim 1, further comprising a bonded portion bonded to the passage portion while supporting the spaced portion to maintain a distance between the spaced portion and the passage portion, wherein the protrusion is provided opposite to the bonded portion with respect to the driving portion.

3. The ink-jet head according to claim 1, wherein the protrusion is provided on the spaced portion.

4. The ink-jet head according to claim 3, wherein the protrusion faces the passage portion and has such a height that a front end of the protrusion is positioned at a level beyond a level of a surface of the driving portion facing the spaced portion.

5. The ink-jet head according to claim 3, wherein the protrusion does not face the passage portion and has such a height that a front end of the protrusion is positioned at a level beyond a level of the surface of the passage portion facing the spaced portion.

6. The ink-jet head according to claim 3, wherein the power supply member is in abutment with at least either of the protrusion and the passage portion.

7. The ink-jet head according to claim 3, wherein the power supply member is in abutment with both of the protrusion and the passage portion.

8. The ink-jet head according to claim 1, wherein the plurality of pressure chambers are arrayed in matrix along a bonded surface bonded to the driving portion, the driving portion has piezoelectric sheets extending across the plurality of pressure chambers and a plurality of individual electrodes arranged on the piezoelectric sheets to correspond to the respective pressure chambers and is bonded to the passage portion, and the power supply member supplies driving signals to the respective individual electrodes of the driving portion.

9. The ink-jet head according to claim 1, wherein a whole area of the driving portion faces the spaced portion.

10. The ink-jet head according to claim 1, wherein the spaced portion includes an ink reservoir in which ink is stored and from which the stored ink is fed to the individual ink passages of the passage portion.

11. An ink-jet head, comprising:

a passage unit in which a plurality of ink ejecting nozzles are formed, the passage unit including a plurality of individual ink passages running to the nozzles through pressure chambers;

a reservoir unit including an ink reservoir in which ink is stored and from which the stored ink is fed to the passage unit;

an actuator unit bonded to the passage unit for imparting squirting energy to the ink in the pressure chambers; and a power supply member electrically connected with the actuator unit for supplying driving signals to the actuator unit;

wherein the reservoir unit has a bonded surface bonded to the passage unit and a spaced surface extended across and spaced apart from the actuator unit, a protrusion is provided in an area of the spaced surface of the reservoir unit, the area is opposite to the bonded surface with respect to an area facing the actuator unit, and the power supply member is in abutment with both of the protrusion and the passage unit, and a sealing member for sealing a space between the passage unit and the reservoir unit is disposed at the abutment portion with the sealing member on a lateral side of the ink-jet head at a location where the power supply member is drawn out.

12. The ink-jet head according to claim 11, wherein a width of the passage unit is not more than a width of the reservoir unit.

* * * * *